United States Patent [19]

Kilpi

[11] Patent Number: 4,621,379

[45] Date of Patent: Nov. 11, 1986

[54] FLUSHING OPERATING MEANS FOR VACUUM TOILET

[75] Inventor: Vaino Kilpi, Espoo, Finland

[73] Assignee: Oy Wartsila Ab, Helsinki, Finland

[21] Appl. No.: 689,397

[22] Filed: Jan. 7, 1985

[30] Foreign Application Priority Data

Jan. 11, 1984 [FI] Finland ..... 840086

[51] Int. Cl.[4] ..... E03D 3/10

[52] U.S. Cl. ..... 4/431; 137/205; 137/492.5

[58] Field of Search ..... 4/431–434, 4/435, 438, 361, 362, 323, 316; 137/DIG. 8, 205, 492.5, 526; 251/82

[56] References Cited

U.S. PATENT DOCUMENTS

| | | | |
|---|---|---|---|
| Re. 26,631 | 7/1969 | Abbott . | |
| 2,620,826 | 9/1952 | Johns . | |
| 3,540,590 | 11/1970 | Schneider, Jr. | 4/323 |
| 3,654,953 | 4/1972 | Hagdorn | 137/492.5 |
| 3,732,579 | 5/1973 | Allander et al. | 4/431 |
| 3,777,778 | 12/1973 | Janu | 4/323 |
| 4,232,409 | 11/1980 | Van Pham | 4/431 |
| 4,357,719 | 11/1982 | Badger et al. | 4/431 |

FOREIGN PATENT DOCUMENTS

| | | |
|---|---|---|
| 185909 | 10/1963 | Sweden . |
| 902871 | 8/1962 | United Kingdom . |

*Primary Examiner*—Stephen Marcus
*Assistant Examiner*—Leo J. Peters
*Attorney, Agent, or Firm*—Dellett, Smith-Hill and Bedell

[57] ABSTRACT

Flushing operating means for a toilet or the like connected to a vacuum sewer, comprising flushing operating means such as a motor generating force by means of the vacuum of the sewer, a water valve, a sewer valve, and valve operating means for opening and closing of the water valve and the sewer valve when the toilet is to be drained and flushed. The flushing operating means is prior to the operating of said valves accumulating a sufficient amount of energy for a complete operating cycle of said motor and sewer valves.

26 Claims, 8 Drawing Figures

FLUSHING OPERATING MEANS FOR VACUUM TOILET

Figure 1:
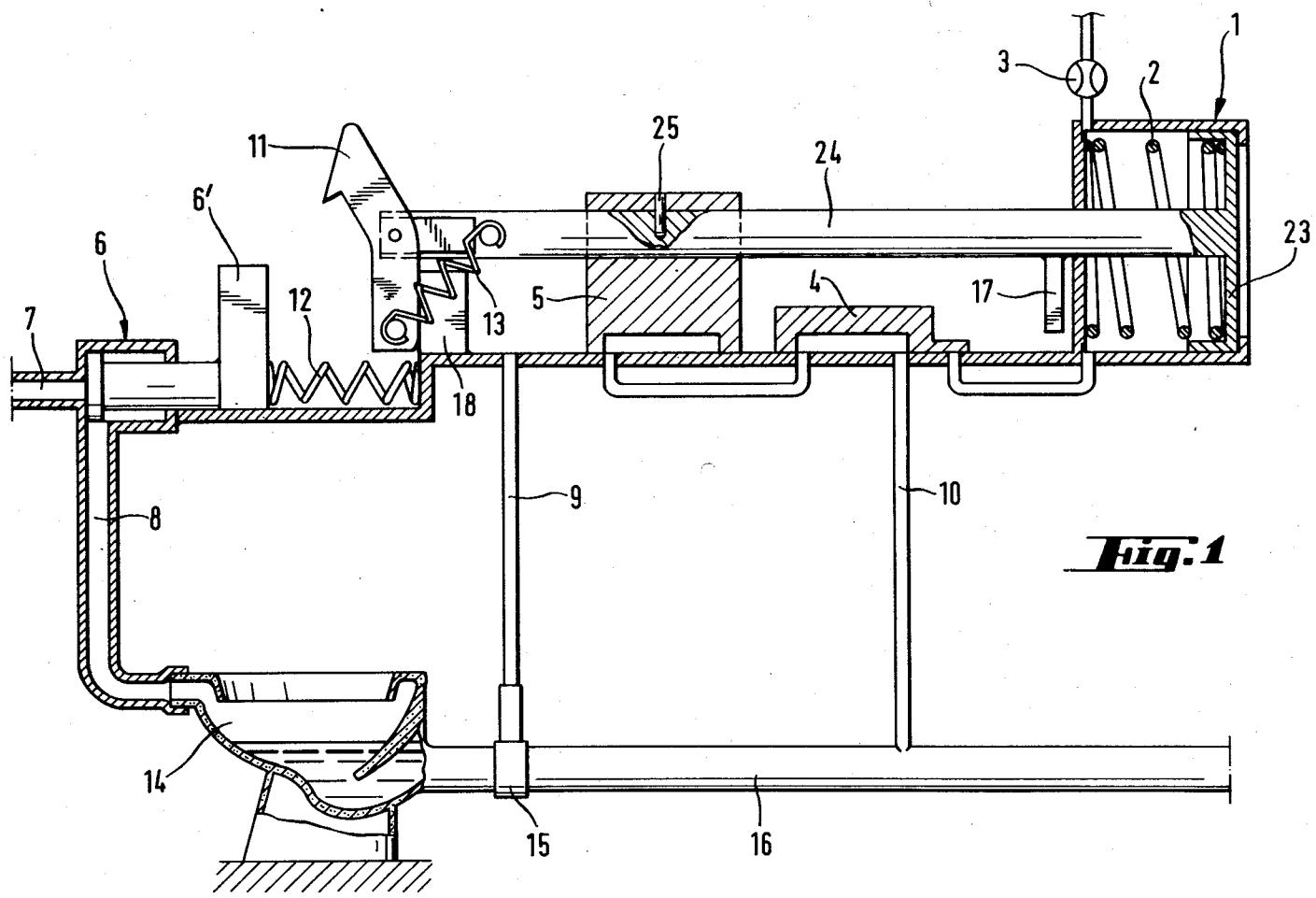
Figure 2:
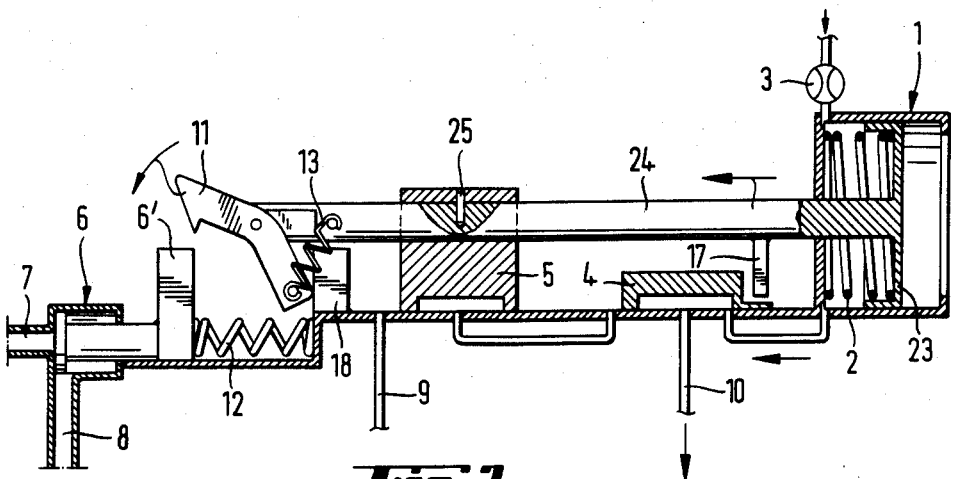

The invention relates to a vacuum sewerage system for a flushable sewage producing unit such as a toilet.

A vacuum sewer has to be kept closed by a sewer valve, which makes the flushing of a toilet connected thereto more difficult than the flushing of a conventional W.C. that is in open connection with a gravity sewer. In order to empty the toilet bowl, the sewer valve is opened for some seconds, during which time waste and flushing water is sucked into the sewer. After the closing of the sewer valve, a suitable amount of water is supplied to form a water pool at the bottom of the bowl. A valve operating device is used for controlling the flushing and the emptying of the bowl. It is convenient to use the vacuum of the sewer for operating the valve operating device, but the problem is that the vacuum fades away when the sewer valve is opened. Water pressure could also be used for operating the valves, but in case of vacuum failure flushing would be supplied but no emptying of the bowl would occur. A valve operating device using both vacuum and water pressure is not reliable because it is influenced by pressure fluctuations in two separate systems.

Swedish Patent Publication No. 185 909 shows a vacuum operated control device comprising a vacuum cylinder. The whole function of the control device, including the periods of time when the water and sewer valves are open, is dependent on the vacuum of the sewer. Due to this there occurs every so often fluctuations in the amount of flushing water entering the toilet bowl and in the time the sewer valve is open. This known system is very complicated, which influences its reliability in operation. Another known solution is to use a control device operated by two separate vacuum cylinders, the first of which fixes the time when the water valve is open and the other one times the sewer valve. Also this solution is complicated and its operation is easily mixed up, if the device is restarted in the midst of its function.

The object of the invention is to solve the problems mentioned above by creating a simplified and economical operating means for the flushing of a vacuum operated toilet. The object is furthermore to create operating means which continue to control the water and sewer valves in spite of fluctuations of the vacuum in the sewer. Still another object is to create a device which prevents starting of the flushing operation if the vacuum of the sewer is too small for a proper sewer transport function.

The characteristic features of the invention are disclosed in claim 1. The vacuum operated flushing means according to the invention is operated by a vacuum cylinder. In one embodiment, a return spring is compressed by the motion of the cylinder piston, and this spring is strong enough to open the water valve. Alternatively the vacuum cylinder is provided with a vacuum big enough to exceed the counter force of a water valve to be opened against pressure and particular holders, thereafter carrying out a stroking motion. After this the time during which the sewer valve is open is dependent on the reverse motion of the piston, which is determined by a throttled air flow back into the evacuated cylinder. In the embodiment, the water valve is closed somewhat before the reverse motion is ended, by unfastening the coupling between the water valve and the piston rod, and in the modification that works in the stroking mode the water valve is closed when the reverse motion has ended. The word vacuum relates here to a partial vacuum of the kind used in vacuum sewerage systems.

When the energy required for carrying out the whole control operation is accumulated in a return spring, by the force of which the reverse motion of the piston is driven and the sewer and water valves are controlled, the starting of the control operation must be prevented during the loading phase. The water valve will be opened not before the reverse motion of the piston by means of a coupling mechanism, which is clutching the water valve when the cylinder has reached its extreme position. The draining control valve, which is rigidly attached to the piston rod, is able to connect the vacuum to the sewer valve not until the reverse motion so, that the starting valve and the draining control valve are coupled in series, whereat the vacuum enters the sewer valve through the drain control valve and the starting valve when the starting valve has moved to its first position, when the cylinder has reached its extreme position.

The operating means cooperates with a known kind of sewer valve to be opened by vacuum, for example as shown in U.S. Pat. No. 3,984,080. The valve shown in U.S. Pat. No. 3,984,080 comprises a cylindrical tube that has a flexible wall and is connected in a flow duct. On its downstream side, the duct is connected to a source of vacuum. A closed chamber that is connected either to the ambient air or to the downstream side of the flow duct surrounds the cylindrical tube. The chamber has a cylindrical wall and two opposite end caps that are connected to the cylindrical wall of the chamber by annular flexible cones, and struts extend from the end caps around the cylindrical tube. Springs urge the end caps apart. When ambient pressure is communicated to the chamber, the springs hold the end caps at the maximum distance from each other, and the struts pinch the cylindrical tube closed. When vacuum is communicated to the chamber, the end caps are drawn closer together, against the force of the springs, and the cylindrical tube is released. All the parts that the operating means is comprising are known per se. The water valve may be a disc valve, which is opened or closed against pressure, or a globe valve. Instead of a vacuum cylinder there may be used different kinds of vacuum motors.

The invention will in the following be described more accurately with reference to the accompanying drawing, in which FIGS. 1, 2, 3 and 4 illustrate the function of an operating means loading energy in a return spring, while FIGS. 5, 6, 7 and 8 illustrate the function of an operating means loading energy in pressure differences.

FIGS. 1–4 show a vacuum cylinder 1, a return spring 2, a throttle valve 3, a starting valve 4, a draining control valve 5, a water valve 6, a pin 6' of the water valve, a connection 7 to the network of water pipes, an outlet duct 8 for flushwater, a vacuum connection 9 to the sewer valve, a connection 10 to the sewer, a coupling hook 11, a locking spring 12 of the water valve, a load spring 13 of the coupling hook, a toilet bowl 14, a sewer valve 15 (for example of the kind shown in U.S. Pat. No. 3,984,080), a sewer 16, a steering bar 17 and a control bar 18, a piston 23, a piston rod 24, and a pin 25.

FIGS. 5–8 show furthermore a non-return valve 19, which is throttling the returning flow of air, a combined starting and draining control valve 20, a stabilizing spring 21, and a holder spring 22 preventing too early starting.

Figure 3:
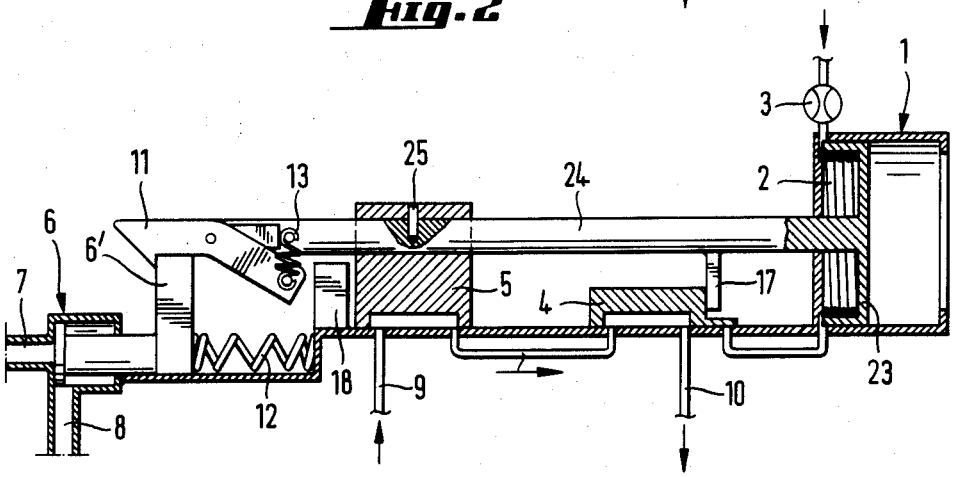
Figure 4:
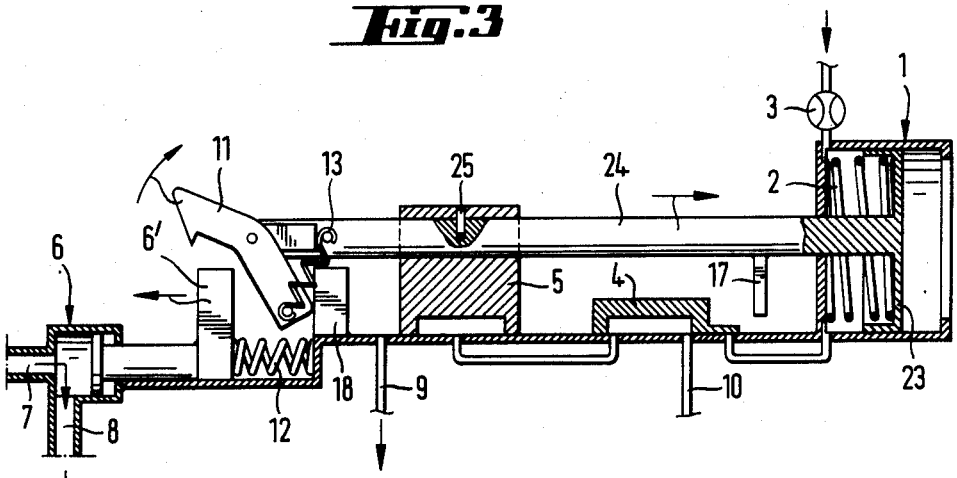
Figure 5:
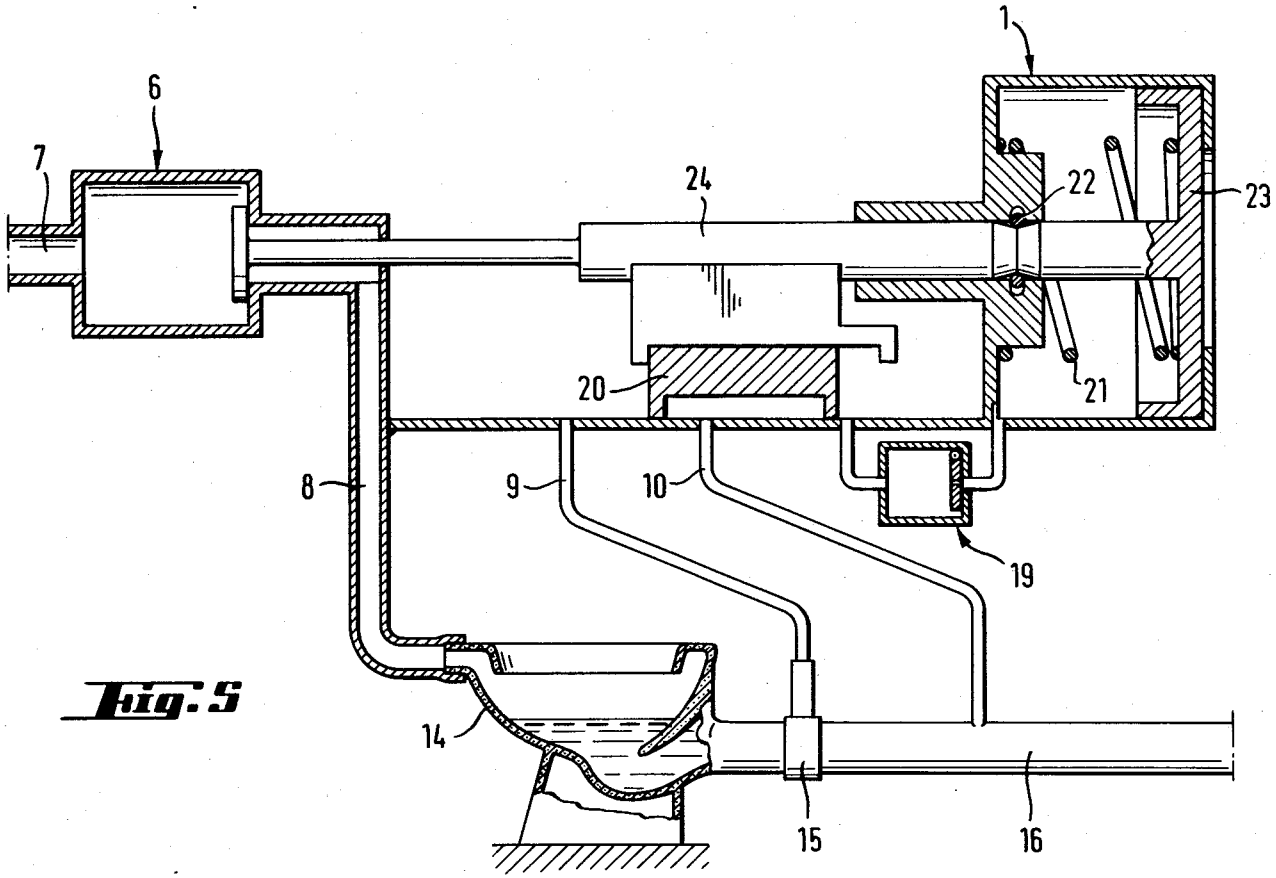
Figure 6:
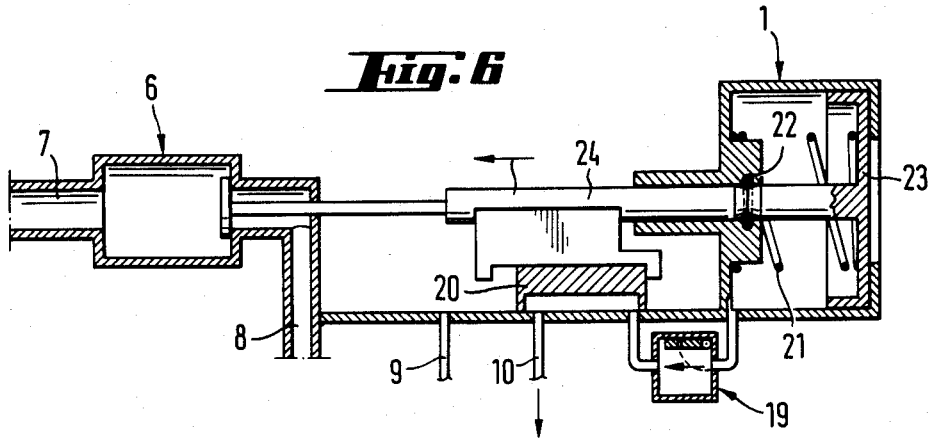
Figure 7:
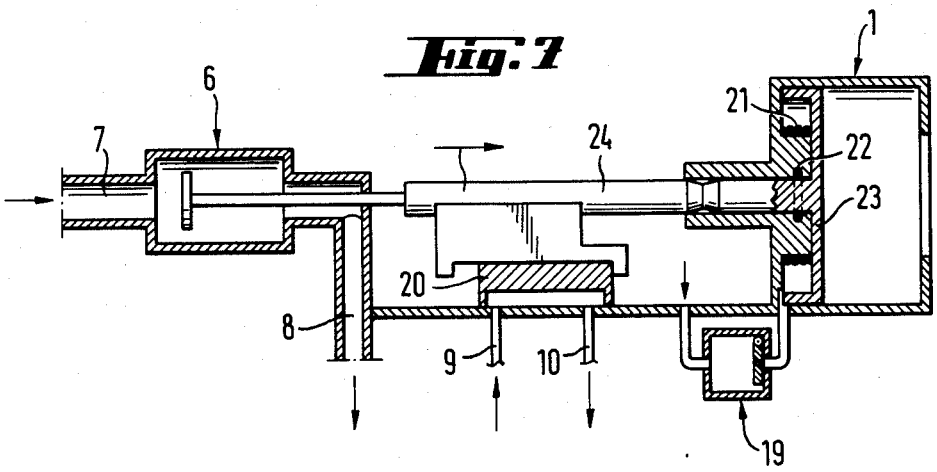

FIG. 1 shows the normal state of operating means loading energy in a return spring. The operation is started by moving the starting valve 4 to such a position that the vacuum of the sewer is able to act upon the vacuum cylinder 1 as it appears from FIG. 2. The starting valve 4 is moving along slots, guide bars or the like in the foundation, and its motion is caused manually or by known power transmission systems. If there is vacuum enough in the sewer, the piston starts moving in the direction of the arrow in FIG. 2. Hereby the return spring 2 is compressed. In FIG. 3 the piston 23 has achieved its extreme position, and the pin 6' of the water valve is coupled to the piston rod 24 by means of the coupling hook 11 and the load spring 13. The starting valve 4 has at the same time moved by influence of the steering bar 17 of the piston rod 24 to its first position, whereat the cylinder 1 is disconnected from the vacuum of the sewer 16. At the same time the draining control valve 5, which is rigidly attached to the piston rod 24 by means of the pin 25, has moved to a position upon the vacuum connection 9 of the sewer valve 15, whereat the vacuum of the sewer 16 is able to open the sewer valve 15 through the starting valve 4 and the draining control valve 5. Air enters the vacuum cylinder 1 through the throttle valve 3 and the piston is returned towards its first position by means of the energy of the compressed return spring 2, which motion is shown in FIG. 4. This reverse motion is the actual control operation. The returning piston rod 24, by means of the coupling hook 11 and the pin 6', draws the water valve 6 to an open position, and flushing water is able to enter the toilet bowl 14 through the duct 8. When the draining control valve 5, following the motion of the piston rod 24, is moved away from its position over the vacuum connection 9 to the sewer valve 15, the air pressure is able to close the sewer valve 15. The control bar 18 disconnects the coupling hook 11 from the pin 6' somewhat after the closing of the sewer valve 15, so that there will be formed a water pool in the bowl 14 before the water valve 6 is closed. The water valve 6 is closed by means of the power of the compressed locking spring 12. Finally the operating means is returning to its normal position.

Figure 8:
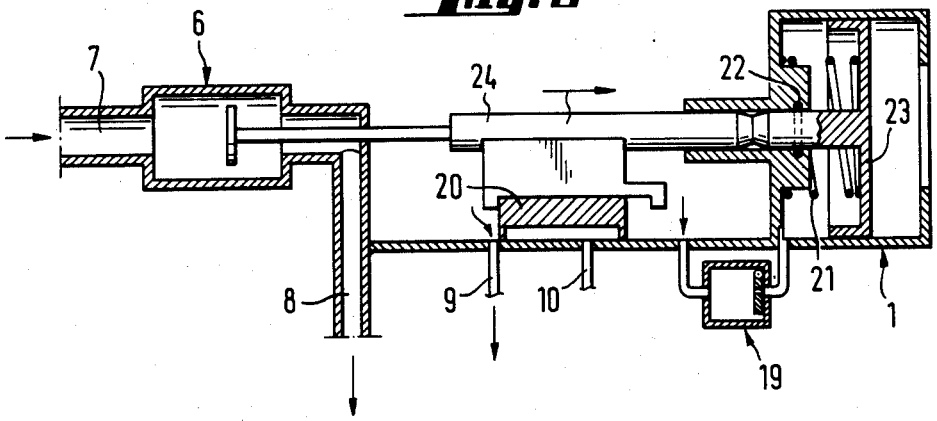

FIGS. 5–8 show the function of operating means loading energy in a pressure difference. The starting happens, as it appears from FIG. 5 and 6, by moving the combined starting and draining control valve 20 to a position, where the vacuum of the sewer 16 is able to suck air from the vacuum cylinder 1 through the valves 20 and 19, so that pressure difference between outer air pressure and the internal pressure of the cylinder 1 becomes large enough to exceed the counter force of the holder spring 22, the stabilizing spring 21 and the water valve 6. After this the piston 23 carries out a stroking motion and moves to the position presented in FIG. 7, opening at the same time the water valve 6 and moving the control valve 20 upon the vacuum connection 9 of the sewer valve 15, whereat the vacuum is able to open the sewer valve 15. The toilet bowl 14 is flushed and drained. FIG. 8 presents the reverse motion of the piston 23, the velocity of which is dependent on the non-return valve 19, which is throttling the returning flow of air to the cylinder 1. When the control valve 20 moves away from above the vacuum connection 9 of the sewer valve, the air pressure is able to close the sewer valve 15. The water valve 6 remains open until the piston achieves its first position shown in FIG. 5, so that there will be formed a water pool in the bowl 14.

The operation of a single-cylinder energy charging operation means is always of the same kind independently of fluctuations in water pressure in the connection 7 or in the vacuum of the sewer 16. The periods of time, when the water and sewer valves 6 and 15 are open, stay constant, because they are only dependent on the outer air pressure and the setting of the throttle valve 3 or the throttled return flow of the non-return valve 19. The vacuum needed for starting of the operating means may also be adjusted to the magnitude required for proper sewer transport function, by choosing suitable springs 2, 12 and 21 and by adjusting the holder spring 22 so that if the vacuum in the sewer is too low, the water and sewer valves are not opened.

The invention is not confined to the presented construction, but several modifications of the invention are feasible within the scope of the attached claims.

I claim:

1. A valve control mechanism for a flushable sewage producing unit, such as a toilet, having a flushing water inlet and also having a sewage output for connection to a vacuum sewer, comprising a normally-closed water valve having an inlet for connection to a source of water under pressure and an outlet for connection to the flushing water inlet of a sewage producing unit, a normally-closed sewer valve that can be interposed between the sewage outlet of the sewage producing unit and a vacuum sewer, a motor that is operable by vacuum and has an output member that is movable from an initial position, in which both the water valve and the sewer valve are closed, through a range of positions in which the output member opens and closes the water valve and the sewer valve, and back to the initial position, an operating valve having an inlet for connection to the vacuum sewer and having a condition in which its inlet is connected to the motor to initiate operation of the motor by communicating vacuum to the motor, and means for accumulating sufficient potential energy when vacuum has been communicated to the motor, and before the water valve and the sewer valve are opened, to cause the output member to move through its range of positions and back to the initial position.

2. A valve control mechanism according to claim 1, wherein the means for accumulating potential energy comprise a spring element.

3. A valve control mechanism according to claim 2, wherein the output member is movable in reciprocating fashion along a linear path between its initial position and an opposite end position, and during movement from the initial position to the opposite end position the spring element is stressed so that the spring element causes the output member to return to the initial position.

4. A valve control mechanism according to claim 2, wherein the motor includes a movable element and the spring element is acted upon by the movable element for stressing the spring element to effect accumulation of potential energy.

5. A valve control mechanism according to claim 1, wherein the means for accumulating potential energy comprise a vacuum chamber, whereby potential energy is accumulated by creating a difference between the pressure inside the vacuum chamber and the ambient pressure.

6. A valve control mechanism according to claim 5, wherein the motor is a positive-displacement motor including a vacuum cylinder, a piston and a piston rod, and said vacuum cylinder constitutes the vacuum chamber.

7. A valve control mechanism according to claim 1, wherein the output member is movable in reciprocating fashion along a linear path between its initial position and an opposite end position.

8. A valve control mechanism according to claim 7, wherein the motor is a positive-displacement motor comprising a vacuum cylinder, a piston and a piston rod, said piston rod constituting the output member of the motor.

9. A valve control mechanism according to claim 8, wherein the means for accumulating potential energy comprise resilient means that are stressed during movement of the piston rod from the initial position to the opposite end position, the operating valve maintaining connection between its inlet and the vacuum cylinder of the motor during at least a first portion of the movement of the piston rod from the initial position towards the opposite end position and not connecting its inlet to the vacuum cylinder during movement of the piston rod from the opposite end position to the initial position, and the valve control mechanism including valve operating means that are operable by the piston rod when the piston rod is at the opposite end position to open the sewer valve and are operable by the piston rod during movement of the piston rod from the opposite end position to the initial position to open and close the water valve and to close the sewer valve.

10. A valve control mechanism according to claim 9, wherein the vacuum cylinder is provided with a throttle valve for connecting the vacuum cylinder to the ambient air, for admitting air at a controlled rate into the vacuum cylinder.

11. A valve control mechanism according to claim 9, wherein the sewer valve is the kind that is opened by vacuum and closed by pressure of ambient air, and the valve operating means comprise a normally-closed drain control valve that has an inlet and has a first condition in which its inlet is isolated from the sewer valve and a second condition in which is inlet is connected to the sewer valve, and the operating valve has a condition in which its inlet is connected to the inlet of the drain control valve, and the valve control mechanism comprising means coupled to the piston rod for changing the operating valve from the condition in which its inlet is connected to the motor to the condition in which its inlet is connected to the inlet of the drain control valve, and for placing the drain control valve in its second condition, during movement of the piston rod from its initial position to its opposite end position, whereby the operating valve and the drain control valve connect the inlet of the operating valve to the sewer valve to bring about opening thereof.

12. A valve control mechanism according to claim 9, comprising a coupling mechanism connected to the piston rod for engaging the water valve and causing the water valve to be opened during movement of the piston rod from its opposite end position to its initial position.

13. A valve control mechanism according to claim 12, comprising a spring element that is stressed upon opening of the water valve and that closes the water valve when the water valve is released by the coupling mechanism.

14. A valve control mechanism according to claim 8, wherein the means for accumulating potential energy comprise said vacuum cylinder and means for preventing movement of the piston rod from its first position towards its opposite end position until sufficient potential energy has been accumulated by virtue of difference between the pressure inside the vacuum cylinder and the ambient pressure to cause the piston rod to move through its range of positions and back to the initial position.

15. A valve control mechanism according to claim 14, wherein the means for preventing movement of the piston rod comprise a holder spring.

16. A valve control mechanism according to claim 14, wherein the water valve comprises a valve member that is moved against the pressure of the source of water for opening the water valve.

17. A valve control mechanism according to claim 14, comprising a throttle valve for admitting air into the vacuum cylinder, thereby controlling the speed at which the piston rod moves from the opposite end position to the initial position.

18. A valve control mechanism according to claim 14, wherein the operating valve has a first condition in which its inlet is connected to the vacuum cylinder, a second condition in which its inlet is connected to the sewer valve and a third condition in which its inlet is not connected to either the vacuum cylinder or the sewer valve, the valve control mechanism also comprising means coupled to the piston rod for changing the operating valve from its first condition during movement of the piston rod from its initial position to its opposite end position, and to maintain the operating valve in its second condition during at least part of the motion of the piston rod from the opposite end position to the initial position.

19. A valve control mechanism according to claim 8, wherein the vacuum cylinder is provided with a throttle valve for connecting the vacuum cylinder to the ambient air, for admitting air at a controlled rate into the vacuum cylinder, whereby movement of the output member to positions in which the water valve and the sewer valve are open is delayed in the event that the vacuum communicated to the motor is below a predetermined value.

20. A valve control mechanism according to claim 1, comprising means for preventing movement of the output member to positions in which the water valve and the sewer valve are open in the event that the vacuum communicated to the motor is below a predetermined value.

21. A valve control mechanism according to claim 1, wherein the range of positions of the output member is such that upon movement of the output member from its initial position through its range of positions, it arrives at the position in which it closes the sewer valve before it arrives at the position in which it closes the water valve.

22. A valve control mechanism according to claim 1, wherein the sewer valve is of the kind that is opened by vacuum and is closed by pressure of ambient air.

23. A valve control mechanism according to claim 1, wherein, during movement of the output member of the motor through its range of positions, the output member reaches the position at which the water valve is opened before it reaches the position at which the sewer valve is closed.

24. A vacuum sewerage system comprising a flushable sewage producing unit, such as a toilet, having a flushing water inlet and also having a sewage outlet, a vacuum sewer, a source of water under pressure, and a valve control mechanism for the sewage producing unit, said valve control mechanism comprising;

a normally-closed water valve having an inlet connected to the source of water under pressure and an outlet connected to the flushing water inlet of the sewage producing unit, a normally-closed sewer valve interposed between the sewage outlet of the sewage producing unit and the vacuum sewer, a motor that is operable by vacuum and has an output member that is movable from an initial position, in which both the water valve and the sewer valve are closed, through a range of positions in which the output member opens and closes the water valve and the sewer valve and back to the initial position, an operating valve having an inlet for connection to the vacuum sewer and having a condition in which its inlet is connected to the motor to initiate operation of the motor by communicating vacuum to the motor, and means for accumulating sufficient potential energy when vacuum has been communicated to the motor, and before the water valve and the sewer valve are opened, to cause the output member to move through its range of positions and back the initial position.

25. A vacuum sewage system according to claim 24, wherein, during movement of the output member of the motor through its range of positions, the output member reaches the position at which the water valve is opened before it reaches the position at which the sewer valve is closed.

26. A vacuum sewerage system according to claim 24, wherein the motor is a positive-displacement motor comprising a vacuum cylinder, a piston and a piston rod, said piston rod constituting the output member of the motor.

* * * * *